US010364939B2

(12) United States Patent
Uchiyama

(10) Patent No.: US 10,364,939 B2
(45) Date of Patent: Jul. 30, 2019

(54) FREE-STANDING LINER UNIT AND METHOD OF BUILDING TANK

(71) Applicant: IHI Corporation, Tokyo (JP)

(72) Inventor: Norio Uchiyama, Tokyo (JP)

(73) Assignee: IHI CORPORATION (JP)

( * ) Notice: Subject to any disclaimer, the term of this patent is extended or adjusted under 35 U.S.C. 154(b) by 227 days.

(21) Appl. No.: 14/395,562

(22) PCT Filed: Feb. 28, 2013

(86) PCT No.: PCT/JP2013/055509
§ 371 (c)(1),
(2) Date: Oct. 20, 2014

(87) PCT Pub. No.: WO2013/161385
PCT Pub. Date: Oct. 31, 2013

(65) Prior Publication Data

US 2015/0053692 A1 Feb. 26, 2015

(30) Foreign Application Priority Data

Apr. 26, 2012 (JP) ..... 2012-101266

(51) Int. Cl.
*F17C 13/00* (2006.01)
*F17C 3/02* (2006.01)
(Continued)

(52) U.S. Cl.
CPC ..... *F17C 3/022* (2013.01); *E04H 7/18* (2013.01); *F17C 3/04* (2013.01);
(Continued)

(58) Field of Classification Search
CPC .... F17C 3/04; F17C 3/022; F17C 2201/0109; F17C 2201/0119; F17C 2201/032;
(Continued)

(56) References Cited

U.S. PATENT DOCUMENTS 3,300,943 A 1/1967 Owens ..... 52/744
3,583,592 A * 6/1971 Kerfman ..... F17C 3/022 220/560.12

(Continued)

FOREIGN PATENT DOCUMENTS

CN 101343955 A 1/2009
CN 102051992 A 5/2011

(Continued)

OTHER PUBLICATIONS

Singapore Search Report and Written Opinion, dated May 19, 2015, issued in corresponding Singapore Patent Application No. 11201406811P. Total 21 pages.
Chinese Office Action, dated Jun. 1, 2015, issued in corresponding Chinese Patent Application No. 201380020885.5. English translation of Search Report. Total 12 pages.
International Search Report and Written Opinion dated May 7, 2013 in corresponding PCT International Application No. PCT/JP2013/055509.

*Primary Examiner* — Fenn C Mathew
*Assistant Examiner* — Elizabeth J Volz
(74) *Attorney, Agent, or Firm* — Ostrolenk Faber LLP

(57) ABSTRACT

A free-standing liner unit (1) is formed by integrating a planar outer tank liner plate (2), a planar secondary barrier plate (3), and a cold insulator layer (4) that is interposed between the outer tank liner plate (2) and the secondary barrier plate (3) into a single unit. According to this free-standing liner unit (1), when building a tank, it is possible to shorten the construction period by performing the formation of the outer tank shell plates and the formation of the tank internal structure concurrently with each other, and to achieve an improvement in the handleability of the free-standing liner unit (1).

7 Claims, 7 Drawing Sheets

(51) Int. Cl.
*E04H 7/18* (2006.01)
*F17C 3/04* (2006.01)

(52) U.S. Cl.
CPC ..... *F17C 2201/0109* (2013.01); *F17C 2201/0119* (2013.01); *F17C 2201/032* (2013.01); *F17C 2201/052* (2013.01); *F17C 2203/035* (2013.01); *F17C 2203/0333* (2013.01); *F17C 2203/0341* (2013.01); *F17C 2203/0631* (2013.01); *F17C 2203/0643* (2013.01); *F17C 2203/0648* (2013.01); *F17C 2203/0678* (2013.01); *F17C 2221/033* (2013.01); *F17C 2223/0161* (2013.01); *F17C 2223/033* (2013.01); *F17C 2260/013* (2013.01); *F17C 2270/0136* (2013.01)

(58) Field of Classification Search
CPC ..... F17C 2201/052; F17C 2203/0333; F17C 2203/0341; F17C 2203/035; F17C 2203/0631; F17C 2203/0643; F17C 2203/0648; F17C 2203/0678; F17C 2223/0161; F17C 2223/033; F17C 2260/013; F17C 2270/0136; F17C 2221/033
USPC ... 220/560.1, 560.12, 565, 901, 592.26, 651
See application file for complete search history.

(56) References Cited

U.S. PATENT DOCUMENTS

| | | | | |
|---|---|---|---|---|
| 6,035,795 | A | 3/2000 | Dhellemmes | 114/74 A |
| 2006/0086741 | A1 | 4/2006 | Bacon | 220/560.12 |
| 2008/0000172 | A1 | 1/2008 | Dhellemmes | 52/171.3 |
| 2008/0302804 | A1 | 12/2008 | Simmons | 220/560.05 |

FOREIGN PATENT DOCUMENTS

| | | | | |
|---|---|---|---|---|
| JP | 51-129914 | | 11/1976 | |
| JP | 54-002507 | | 1/1979 | |
| JP | 58-123119 | | 8/1983 | |
| JP | 05-180393 | | 7/1993 | |
| JP | 2001-180793 | | 7/2001 | |
| JP | 2002-276894 | | 9/2002 | |
| JP | 2002276894 | * | 9/2002 | F17C 3/04 |
| JP | 2003-240197 | | 8/2003 | |
| JP | 2010-106501 | | 5/2010 | |
| SU | 59507 A1 | | 11/1940 | |

* cited by examiner

FREE-STANDING LINER UNIT AND METHOD OF BUILDING TANK

CROSS-REFERENCE TO RELATED APPLICATIONS

The present application is a 35 U.S.C. §§ 371 national phase conversion of PCT/JP2013/055509, filed Feb. 28, 2013, which claims priority to Japanese Patent Application No. 2012-101266, filed Apr. 26, 2012, the contents of which are incorporated herein by reference. The PCT International Application was published in the Japanese language.

TECHNICAL FIELD

The present invention relates to a free-standing liner unit and a method of building a tank.

BACKGROUND ART

Low-temperature liquefied gases such as LNG (Liquefied Natural Gas) are stored, for example, in cylinder-shaped double-shell tanks having an internal tank made of metal and an outer tank made of concrete. The following process is generally followed when building this type of double-shell tank. Concrete outer tank shell plates are formed in a plurality of stages in the height direction from the base, an outer tank roof is then formed inside these and is lifted up. Then, internal tank shell plates are formed underneath the outer tank roof in a plurality of stages in the height direction in the same way as the outer tank shell plates.

In this conventional building method, it is necessary for a large-size forming frame to be set up inside the outer tank side until the outer tank shell plates have been built up to a certain height. Because of this, work to form the tank internal structure on the inside of the outer tank shell plates cannot proceed. For example, an annular plate (i.e., the previously mentioned internal structure) that is used to join together the internal tank shell plates and the bottom plate is positioned inside the tank, however, the task of positioning this annular plate cannot be performed until the outer tank shell plates have been built up to 3 or 4 levels.

In contrast, in Patent Document 1, a method is disclosed in which a precast concrete forming frame that is equipped with an outer tank liner, which is formed by integrating an outer tank liner plate with precast concrete, is used. According to this method, by setting up this precast concrete forming frame equipped with the outer tank liner on a base, and using it as a forming frame for pouring the concrete, the building of the outer tank lower portion can be performed concurrently with the forming of the tank internal structure.

PRIOR ART DOCUMENT

Patent Documents

[Patent Document 1] Japanese Unexamined Patent Application, First Publication No. 2010-106501

SUMMARY OF THE INVENTION

Problems to be Solved by the Invention

For example, one idea that may be considered is to apply the technology described in Patent Document 1, and to integrate the outer tank liner plate and a portion of the outer tank shell plates together into a forming frame (i.e., a free-standing liner unit). However, if the outer tank liner plate and the outer tank shell plates, which are made of concrete, are integrated into a single unit, then the weight of this integrated structural body is huge. This causes the workload during its transporting to increase, and the costs incurred in its transporting to increase, so that there is a worsening in the ease of handling of the forming frame.

The present invention was conceived in view of the above-described drawbacks, and it is an object thereof to make it possible to shorten the construction period by performing the formation of the outer tank shell plates and the formation of the tank internal structure concurrently with each other, and to also obtain an improvement in the handleability of the free-standing liner unit.

Means for Solving the Problem

The present invention employs the following structures as a means of solving the above-described problems.

A free-standing liner unit according to a first aspect of the present invention includes a planar outer tank liner plate, a planar secondary barrier plate, and a cold insulator layer that is interposed between the outer tank liner plate and the secondary barrier plate, in which the outer tank liner plate, the secondary barrier plate, and the cold insulator layer are integrated into a single unit.

In the free-standing liner unit according to a second aspect of the present invention, in the free-standing liner unit according to the above-described first aspect, there is further provided a reinforcing means that is fixed to one or a plurality of the outer tank liner plate, the secondary barrier plate, and the cold insulator layer, and provides improved rigidity.

In the free-standing liner unit according to a third aspect of the present invention, in the free-standing liner unit according to the second aspect, the reinforcing means takes the form of anchor bolts that penetrate the outer tank liner plate, the secondary barrier plate, and the cold insulator layer.

In the free-standing liner unit according to a fourth aspect of the present invention, in the free-standing liner unit according to the second aspect, the reinforcing means takes the form of ribs that are fixed to the outer tank liner plate.

A method of building a tank according to a fifth aspect of the present invention has: a step erecting the free-standing liner units according to any of the first through fourth aspects; a step of forming outer tank shell plates that are made of concrete on the outer tank liner plate side of the free-standing liner units; and a step of forming a tank internal structure on the secondary barrier plate side of the free-standing liner units concurrently with the step of forming the outer tank shell plates.

Effects of the Invention

According to the present invention, a free-standing liner unit is formed by an outer tank liner plate, a secondary barrier plate, and a cold insulator layer. In this type of free-standing liner unit, because the outer tank shell plates, which are made of concrete, are not integrated into a single structure, compared to a free-standing liner unit in which the outer tank shell plates are integrated, the weight can be reduced, and the handleability improved. Furthermore, because the free-standing liner unit of the present invention can be used as a forming frame when the concrete shell plates are being formed, it is possible for the tank internal structure to be formed concurrently with the formation of the outer tank shell plates. Accordingly, according to the present invention, it is possible to shorten the construction period when the outer tank shell plates are formed concurrently with the formation of the tank internal structure, and to thereby achieve an improvement in the handleability of the free-standing liner unit.

DESCRIPTION OF EMBODIMENTS

Hereinafter, an embodiment of a free-standing liner unit and a method of building a tank according to the present invention will be described with reference made to the drawings. Note that in the following drawings, the scale of the respective components has been appropriately altered in order to make each component a recognizable size.

Figure 1A:
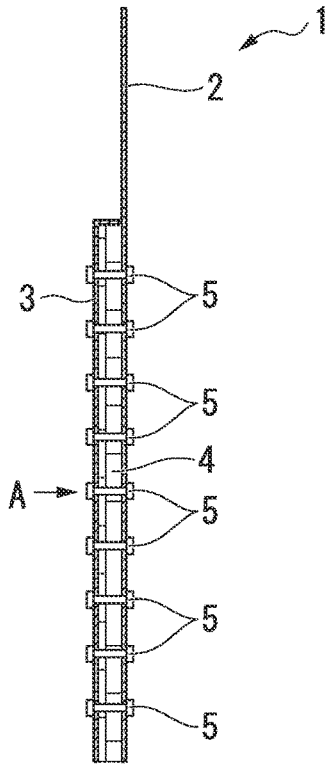
FIG. 1A is a vertical cross-sectional view showing the schematic structure of a free-standing liner unit according to an embodiment of the present invention.
Figure 1B:
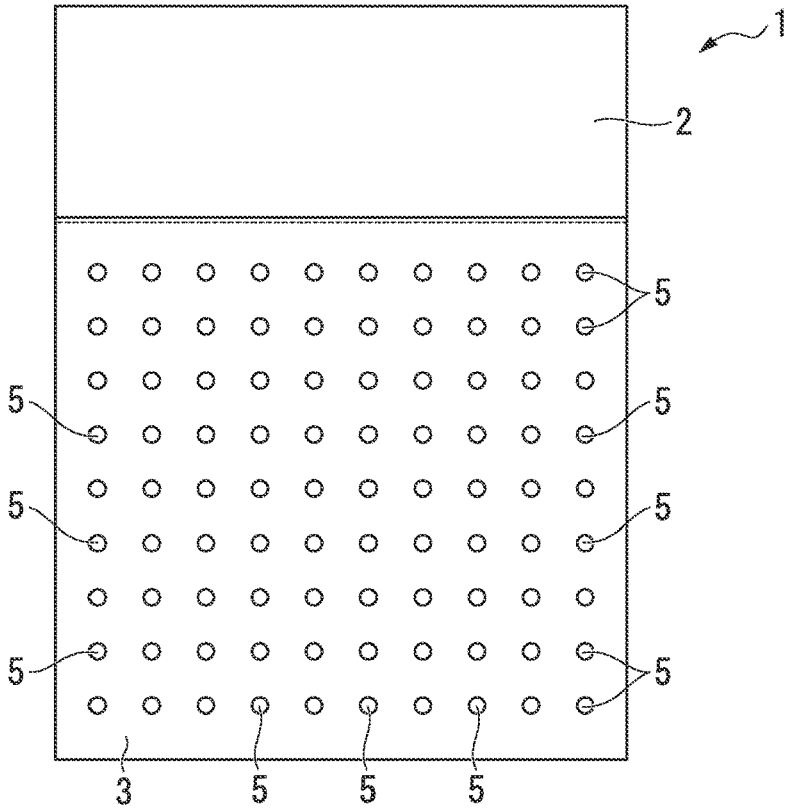
FIG. 1B is a view as seen from the direction of an arrow A in FIG. 1A showing the schematic structure of the free-standing liner unit according to the embodiment of the present invention.

FIGS. 1A and 1B are views showing the schematic structure of a free-standing liner unit 1 of the present embodiment, with FIG. 1A being a vertical cross-sectional view thereof, and FIG. 1B being a view as seen from the direction of an arrow A in FIG. 1A. As is shown in FIG. 1A, a free-standing liner unit 1 of the present embodiment is formed by integrating an outer tank liner plate 2, a secondary barrier plate 3, a cold insulator layer 4, and anchor bolts 5 (i.e., reinforcing means) into a single unit.

The outer tank liner plate 2 is a plate material formed, for example, from stainless steel, and makes up a portion of an outer tank liner 19 that is provided in a tank 10 (described below). As is shown in FIG. 1B, this outer tank liner plate 2 is formed in a rectangular shape that has the same width as the secondary barrier plate 3 and is higher (i.e., longer) than the secondary barrier plate 3.

The secondary barrier plate 3 is a plate material formed, for example, from 9% nickel steel, and makes up a portion of a secondary barrier 17 that is provided in the tank 10 (described below). As is shown in FIG. 1B, this secondary barrier plate 3 is formed in a substantially rectangular shape that has the same width as the outer tank liner plate 2 and is lower (i.e., shorter) than the outer tank liner plate 2. Moreover, the secondary barrier plate 3 is placed such that the position of its bottom edge matches that of the outer tank liner plate 2, and it faces the outer tank liner plate 2 with a uniform gap between them. Note that a top edge portion of the secondary barrier plate 3 is bent towards the outer tank liner plate 2 so that it is connected to the outer tank liner plate 2.

The cold insulator layer 4 is placed between the outer tank liner plate 2 and the secondary barrier plate 3, and is supported by being sandwiched between the outer tank liner plate 2 and the secondary barrier plate 3. This cold insulator layer 4 forms a portion of a second cold insulating layer 18 that is provided in the tank 10 (described below). The cold insulator layer 4 is formed from a cold insulator such as, for example, foam glass, or PUF (rigid urethane foam) or the like.

The anchor bolts 5 penetrate the outer tank liner plate 2, the secondary barrier plate 3, and the cold insulator layer 4, and fasten these together. As is shown in FIG. 1B, a plurality of anchor bolts 5 may be provided, for example, at a fixed pitch both horizontally and vertically. The Anchor bolts 5 increase the force with which the outer tank liner plate 2, the secondary barrier plate 3, and the cold insulator layer 4 are fastened together, and improve the rigidity of the free-standing liner unit 1.

Figure 2:
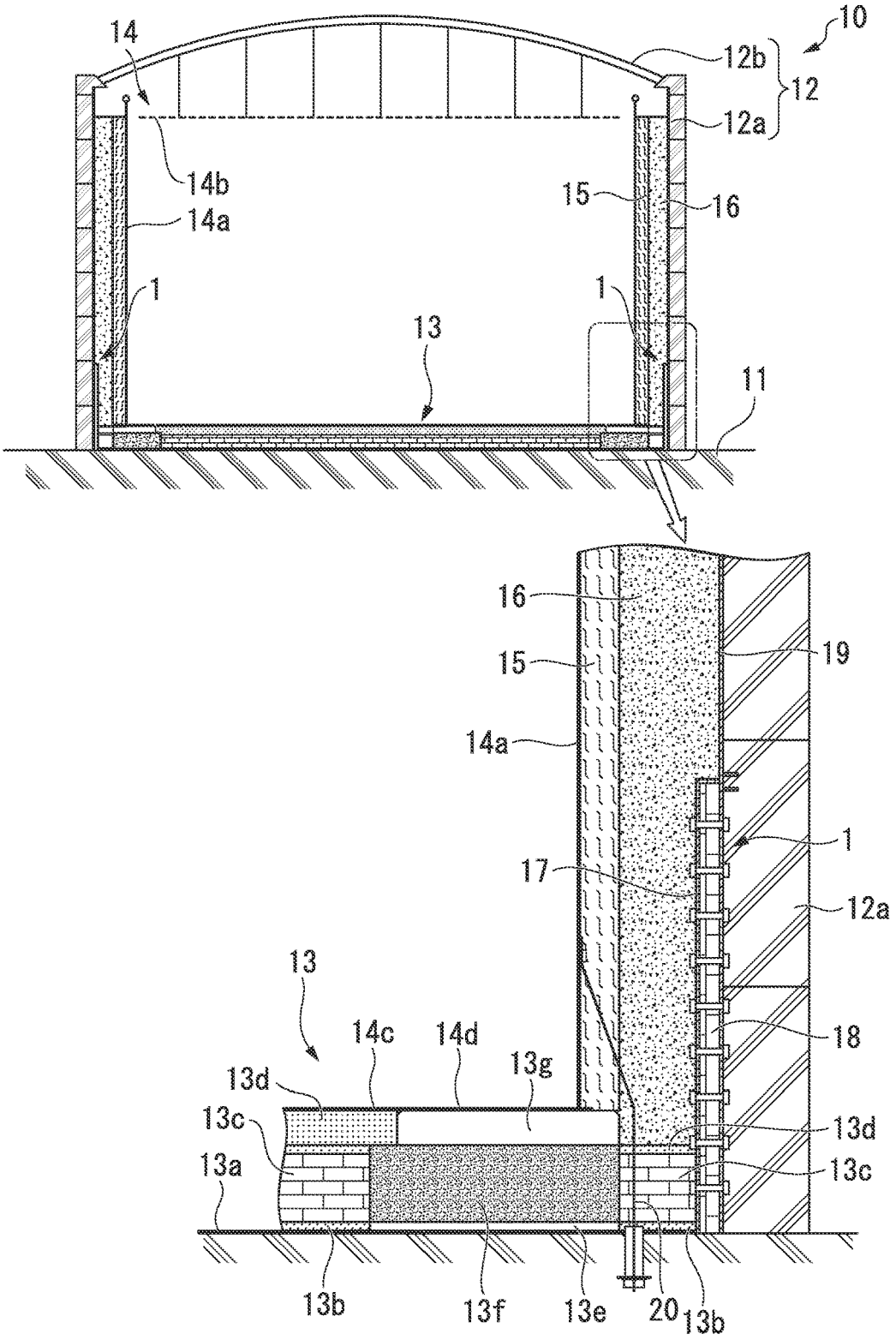
FIG. 2 is a cross-sectional view showing the schematic structure of a tank having the free-standing liner unit according to the embodiment of the present invention.

FIG. 2 is a cross-sectional view showing in typical form the schematic structure of the tank 10 that is provided with the free-standing liner unit 1 of the present embodiment. Note that, in FIG. 2, a corner of the tank 10 in which the free-standing liner unit 1 of the present embodiment is installed is shown in a partial enlargement.

As is shown in FIG. 2, the tank 10 is provided with a base slab 11, an outer tank 12, a bottom plate 13, an inner tank 14, a resilient blanket 15, a first cold insulating layer 16, a secondary barrier 17, a second cold insulating layer 18, an outer tank liner 19, and an anchor strap 20. Note that, although omitted from FIG. 2, the tank 10 is also provided with other equipment such as a feeder pump and manholes and the like.

The base slab 11 is a foundation that is made from reinforced concrete and supports the outer tank 12 and the inner tank 14 and the like. The outer tank 12 is a circular cylinder-shaped container made from concrete that is formed directly on top of the base slab 11 so as to encircle the inner tank 14. This outer tank 12 is formed by outer tank shell plates 12*a* that form a circumferential surface, and an outer tank roof 12*b* that covers a top portion of the outer tank shell plates 12*a*. Note that the outer tank 12 forms the outermost shell of the tank 10. The components present inside this outer tank 12 form the tank internal structure of the present invention.

The bottom plate 13 is formed on the base slab 11 in an area enclosed by the outer tank shell plates 12*a*. As is shown in the enlarged view in FIG. 2, the bottom plate 13 is provided with a bottom liner plate 13*a* that is set up as the bottommost layer, a dry sand layer 13*b* that is provided on top of the bottom liner plate 13*a*, a foam glass layer 13*c* that is provided on top of the dry sand layer 13*b*, and two dry sand layers 13*d* that are provided on top of the foam glass layer 13*c*. Moreover, as is shown in the enlarged portion in FIG. 2, in the vicinity of the corner portion of the tank 10, the bottom plate 13 is also provided with leveling concrete 13*e* that is provided on top of the bottom liner plate 13*a*, a perlite concrete block 13*f* that is provided on top of the leveling concrete 13*e*, and reinforced concrete block 13*g* that is provided on top of the perlite concrete block 13*f* and supports an annular plate 14*d* (described below).

The inner tank 14 is a circular cylinder-shaped container made from metal (for example, 9% nickel steel) that is formed on top of the bottom plate 13 inside the outer tank 12. This inner tank 14 is formed by inner tank shell plates 14*a* that form a circumferential surface, an inner tank deck 14*b* that covers a top portion of the inner tank shell plates 14*a*, an inner tank bottom plate 14*c* that is placed on top of the bottom plate 13, and an annular plate 14*d* that joins the inner tank shell plates 14*a* and the inner tank bottom plate 14*c* together.

The resilient blanket 15 is placed on the outside of the inner tank shell plates 14*a*, and surrounds the entire circumference of the inner tank shell plates 14*a*. The first cold insulating layer 16 is placed on the outside of the resilient blanket 15, and surrounds the entire circumference of the resilient blanket 15. This first cold insulating layer 16 is formed, for example, from perlite. The secondary barrier 17 is placed so as to surround the bottom portion of the inner tank 14 while sandwiching the resilient blanket 15 and the first cold insulating layer 16 between the secondary barrier 17 and the inner tank 14 and, in the unlikely event of the inner tank 14 becoming fractured and LNG or the like leaking out, blocks any LNG leakage. This secondary barrier 17 is formed by joining a plurality of the secondary barrier plates 3 of the free-standing liner units 1 of the present embodiment together in the circumferential direction of the inner tank 14. The second cold insulating layer 18 is placed on the outer side of the secondary barrier 17, and surrounds the entire circumference of the secondary barrier 17. This second cold insulating layer 18 is formed by joining a plurality of the cold insulator layers 4 of the free-standing liner units 1 of the present embodiment together in the circumferential direction of the inner tank 14. The outer tank liner 19 is placed on the inner side of the outer tank shell plates 12*a*, and is provided on the entire circumference of the outer tank shell plates 12*a*. A bottom portion of this outer tank liner 19 is formed by joining a plurality of the outer tank liner plates 2 of the free-standing liner units 1 of the present embodiment together in the circumferential direction of the inner tank 14. The anchor strap 20 is embedded between the inner tank shell plates 14*a* and the outer tank shell plates 12*a*, and supports the inner tank shell plates 14*a*.

Next, a method of building the tank 10 having the above-described structure will be described with reference made to FIG. 3A through FIG. 6B.

Figure 3A:
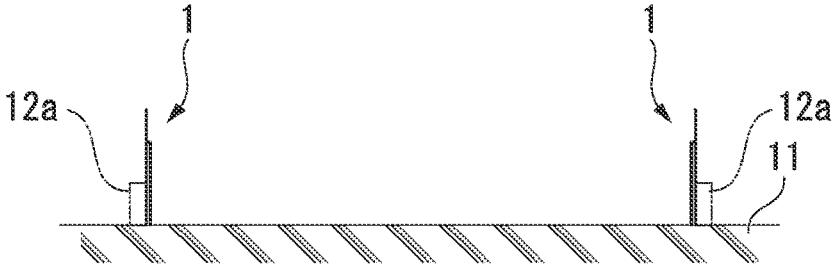
FIG. 3A is a schematic view illustrating a method of building a tank that uses the free-standing liner unit according to the embodiment of the present invention.

Firstly, the base slab 11 is built, and the free-standing liner units 1 of the present embodiment are then erected on top of the base slab 11. Note that, when viewed from above, a plurality of the free-standing liner units 1 are arranged in a toroidal configuration, and are each joined together by welding. After the free-standing liner units 1 are erected in this manner, as is shown in FIG. 3A, the formation of the outer tank shell plates 12*a* is begun on the outer side of the free-standing liner units 1. The outer tank shell plates 12*a* are formed by stacking concrete blocks in a plurality of stages. Note that when the outer tank shell plates 12*a* are being formed on the outer side of the free-standing liner units 1, it is preferable for reinforcing rings or supporting columns or the like to be set up on the inside of the free-standing liner units 1 in order to support the liquid pressure of the concrete prior to it curing.

Figure 3B:
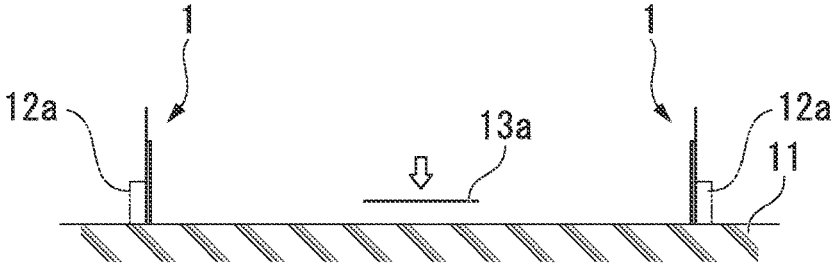
FIG. 3B is a schematic view illustrating the method of building a tank that uses the free-standing liner unit according to the embodiment of the present invention.

When the formation of the outer tank shell plates 12*a* has begun on the outer side of the free-standing liner units 1 in this manner, as is shown in FIG. 3B, the installation of the bottom liner plate 13*a*, which is the tank internal structure, is begun concurrently with the formation of the outer tank shell plates 12*a*. In other words, in the method of building the tank 10 which uses the free-standing liner unit 1 of the present embodiment, at the same time as the formation of the outer tank shell plates 12*a* is begun, the formation of the tank internal structure on the inside of the free-standing liner units 1 can also be started.

Figure 3C:
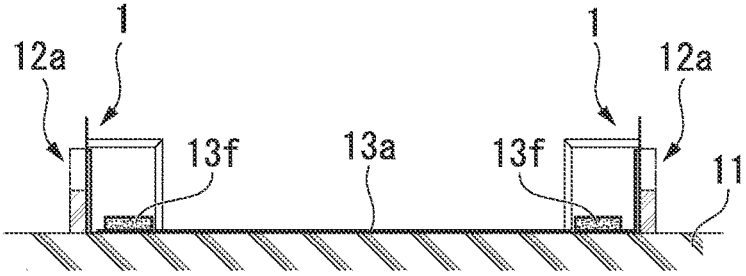
FIG. 3C is a schematic view illustrating the method of building a tank that uses the free-standing liner unit according to the embodiment of the present invention.

Next, as is shown in FIG. 3C, concurrently with the formation of the outer tank shell plates 12*a*, rain shades 30 are set up in the corners of the inner tank 14, and the perlite concrete blocks 13*f* are set in place on top of the leveling concrete 13*e* underneath these rain shades 30. Note that because of the thinness of the leveling concrete 13*e*, it is not shown in FIG. 3C.

Figure 4A:
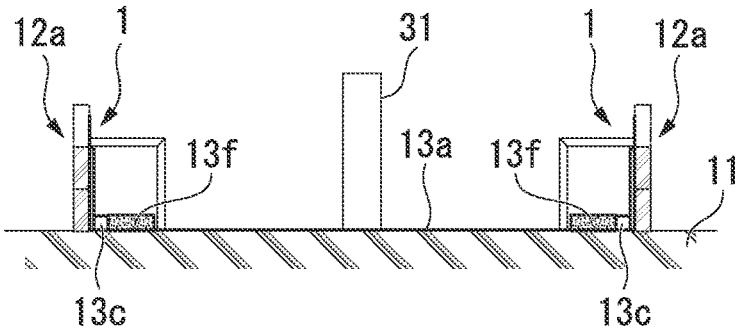
FIG. 4A is a schematic view illustrating the method of building a tank that uses the free-standing liner unit according to the embodiment of the present invention.

Next, as is shown in FIG. 4A, concurrently with the formation of the outer tank shell plates 12*a*, a portion of the bottom plate 13 is formed between the perlite concrete blocks 13*f* and the free-standing liner units 1. Note that the bottom plate 13 that is formed between the perlite concrete blocks 13*f* and the free-standing liner units 1 is formed with sufficient space to install the anchor strap 20 left open. Moreover, as is shown in FIG. 4A, a stand 31 that is used to form the outer tank roof 12*b* is set in place in the center of the substrate 11.

Figure 4B:
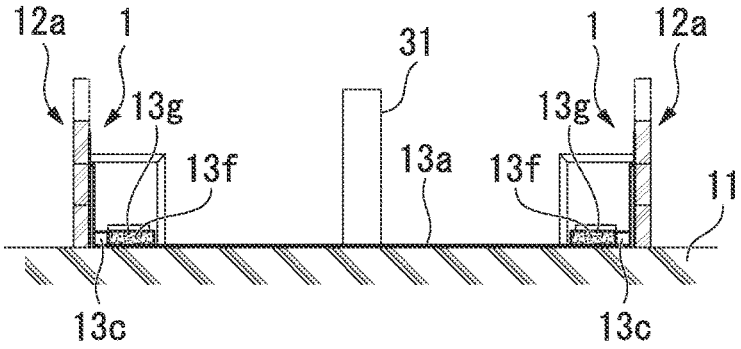
FIG. 4B is a schematic view illustrating the method of building a tank that uses the free-standing liner unit according to the embodiment of the present invention.
Figure 4C:
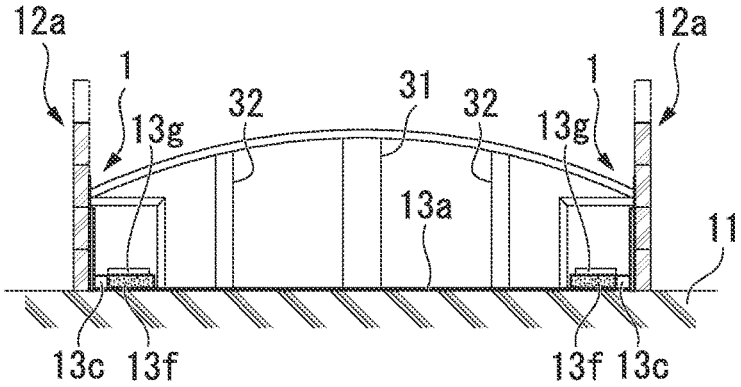
FIG. 4C is a schematic view illustrating the method of building a tank that uses the free-standing liner unit according to the embodiment of the present invention.

Next, as is shown in FIG. 4B, concurrently with the formation of the outer tank shell plates 12*a*, the reinforced concrete 13*g* is installed on top of the perlite concrete blocks 13*f*. Furthermore, as is shown in FIG. 4C, the outer tank roof 12*b* is formed while being supported by supporting columns 32. Note that, as is shown in FIG. 4C, once the outer tank shell plates 12*a* have been formed beyond the free-standing liner units 1, the outer tank liner 19 is formed on those portions that are beyond the free-standing liner units 1.

Figure 5A:
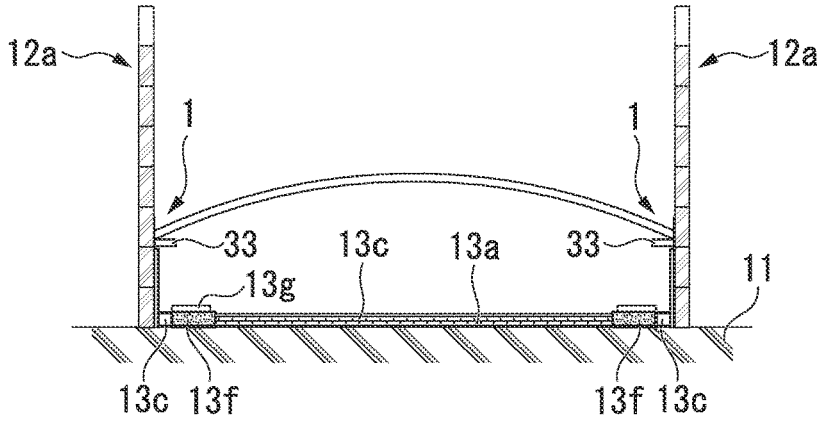
FIG. 5A is a schematic view illustrating the method of building a tank that uses the free-standing liner unit according to the embodiment of the present invention.

Next, concurrently with the formation of the outer tank shell plates 12*a*, supporting pedestals 33 are formed on a portion of the outer tank shell plates 12*a* that have already been formed so as to support the outer tank roof 12*b*. In conjunction with this, the supporting trestle 31 and the supporting columns 32 are removed. Note that, as is shown in FIG. 5A, once the outer tank roof 12*b* has been completed, the dry sand layer 13*b* and the foam glass layer 13*c* of the bottom plate 13 are formed. Note that because of the thinness of the dry sand layer 13*b*, it is not shown in FIG. 5A.

Figure 5B:
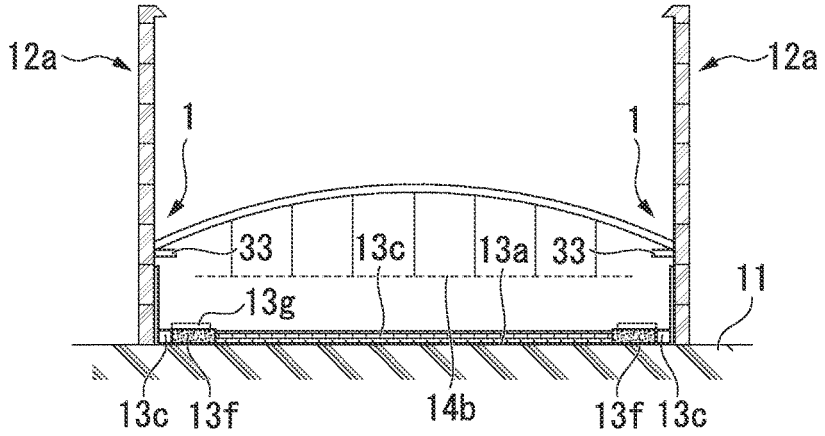
FIG. 5B is a schematic view illustrating the method of building a tank that uses the free-standing liner unit according to the embodiment of the present invention.
Figure 5C:
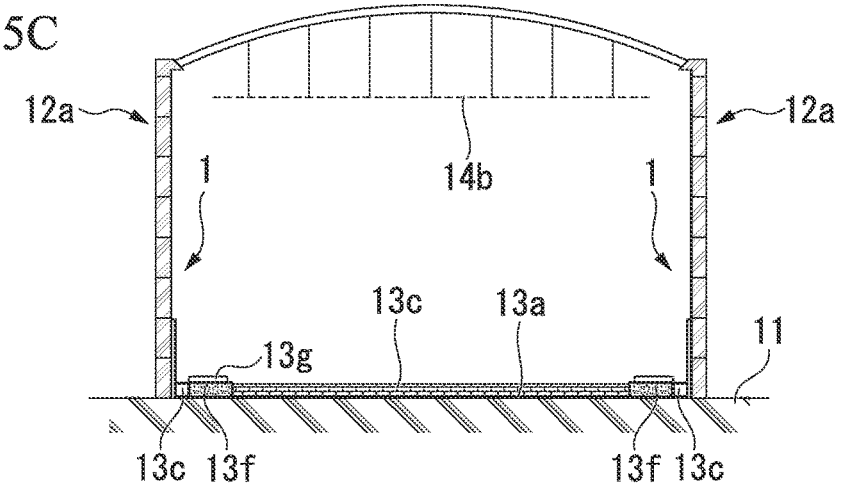
FIG. 5C is a schematic view illustrating the method of building a tank that uses the free-standing liner unit according to the embodiment of the present invention.

Next, concurrently with the formation of the outer tank shell plates 12*a*, as is shown in FIG. 5B, the inner tank deck 14*b* is formed by being suspended from the outer tank outer tank roof 12*b*. Once the outer tank shell plates 12*a* have been completed, as is shown in FIG. 5C, the outer tank roof 12*b* and the inner tank deck 14*b* are raised up by an air lifter, and are fixed to an apex portion of the outer tank shell plates 12*a*. Once this has been done, the outer tank 12 is complete.

Figure 6A:
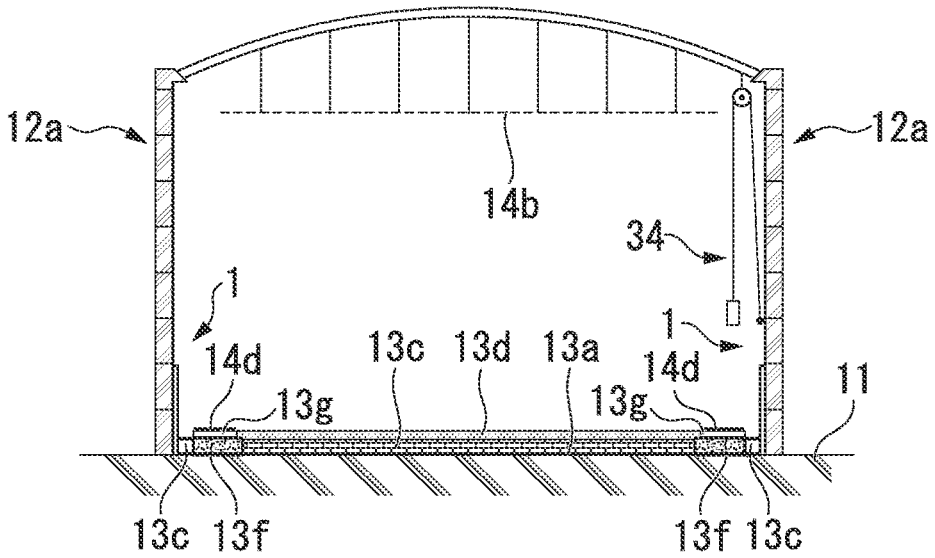
FIG. 6A is a schematic view illustrating the method of building a tank that uses the free-standing liner unit according to the embodiment of the present invention.
Figure 6B:
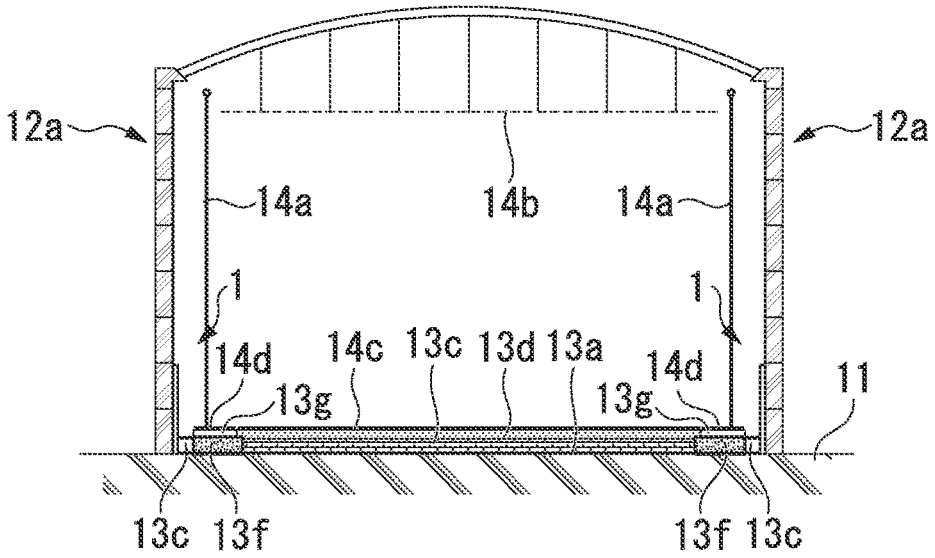
FIG. 6B is a schematic view illustrating the method of building a tank that uses the free-standing liner unit according to the embodiment of the present invention.

Next, as is shown in FIG. 6A, a crane 34 that is used to form the inner tank shell plates 14*a* is set up inside the outer tank 12. Moreover, the annular plate 14*d* is installed on top of the reinforced concrete 13*g*, and the dry sand layer 13*d* is formed on top of the foam glass layer 13*c*. Next, as is shown in FIG. 6B, the inner tank shell plates 14*a* and the inner tank bottom plate 14*c* are formed, and this completes the formation of the inner tank 14. Lastly, the resilient blanket 15, the first cold insulating layer 16, and the anchor strap 20 are installed thereby completing the formation of the tank 10.

Next, the operation and effects of the free-standing liner unit 1 of the present embodiment will be described. The free-standing liner unit 1 of the present embodiment is formed by the outer tank liner plate 2, the secondary barrier plate 3, and the cold insulator layer 4. In this free-standing liner unit 1 of the present embodiment, because the outer tank shell plates 12*a*, which are made of concrete, are not integrated into a single structure, compared with a conventional free-standing liner unit in which the outer tank shell plates are integrated, it is possible to achieve a reduction in weight and an improvement in handleability.

Furthermore, for example, as is shown in FIGS. 3A through 3C, because the free-standing liner units 1 of the present embodiment can be used as a forming frame when the concrete outer tank shell plates 12*a* are being formed, it is possible for the formation of the tank internal structure to be carried out concurrently with the formation of the outer tank shell plates 12*a*. Accordingly, according to the method of building a tank using the free-standing liner units 1 of the present embodiment, it is possible for the formation of the outer tank shell plates 12*a* and the formation of the tank internal structure to be carried out concurrently with each other. Namely, the method of building a tank using the free-standing liner units 1 of the present embodiment has a step in which the tank internal structure is formed on the secondary barrier plate 3 side of the free-standing liner units 1 that is performed concurrently with a step in which the outer tank shell plates 12*a* are formed. Because of this, it is possible to shorten the construction period. In this manner, according to the free-standing liner unit 1 of the present embodiment, handleability is improved, and the construction period can be shortened.

Moreover, in the free-standing liner units 1 of the present embodiment, the anchor bolts 5 that fasten together the outer tank liner plate 2, the secondary barrier plate 3, and the cold insulator layer 4 are provided so as to improve the strength of the outer tank liner plate 2, the secondary barrier plate 3, and the cold insulator layer 4. Because of this, when the free-standing liner units 1 are used as a forming frame, they are able to easily withstand the liquid pressure of the concrete that is acting on the free-standing liner units 1. Note that the rigidity of the free-standing liner units 1 can be altered by modifying the placement pitch of the anchor bolts 5. Because of this, for example, it is also possible to determine the placement pitch of the anchor bolts 5 based on the aforementioned liquid pressure of the concrete. At this time, because the bottom portion of the free-standing liner units 1 receives a higher liquid pressure than the top portion thereof, it is possible for the anchor bolts 5 to be installed at a higher density in the bottom portion of the free-standing units 1 than in the top portion thereof.

While the preferred embodiment of the present invention has been described with reference to the drawings, the present invention is not limited to the aforementioned embodiment. All shapes and combinations of the means and each component shown in the aforementioned embodiment are only examples and may be variously modified based on design requirements without deviation from the gist of the present invention. That is, all shapes and combinations of each component shown in the aforementioned embodiment may allow additions, omissions, substitutions, and other modifications of the constitution without deviation from the spirit of the present invention. The present invention is not limited by the above description, and is only limited by the appended claims.

Figure 7A:
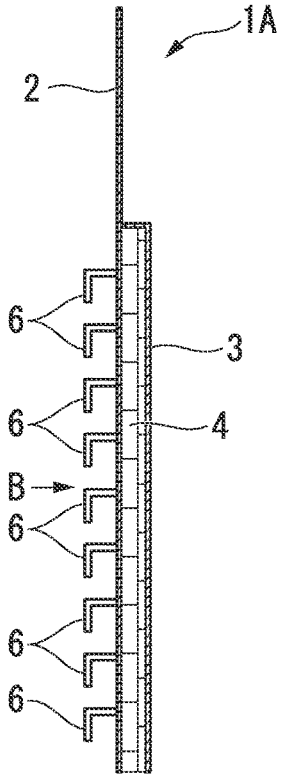
FIG. 7A is a vertical cross-sectional view showing the schematic structure of a free-standing liner unit according to a variant example of the embodiment of the present invention.
Figure 7B:
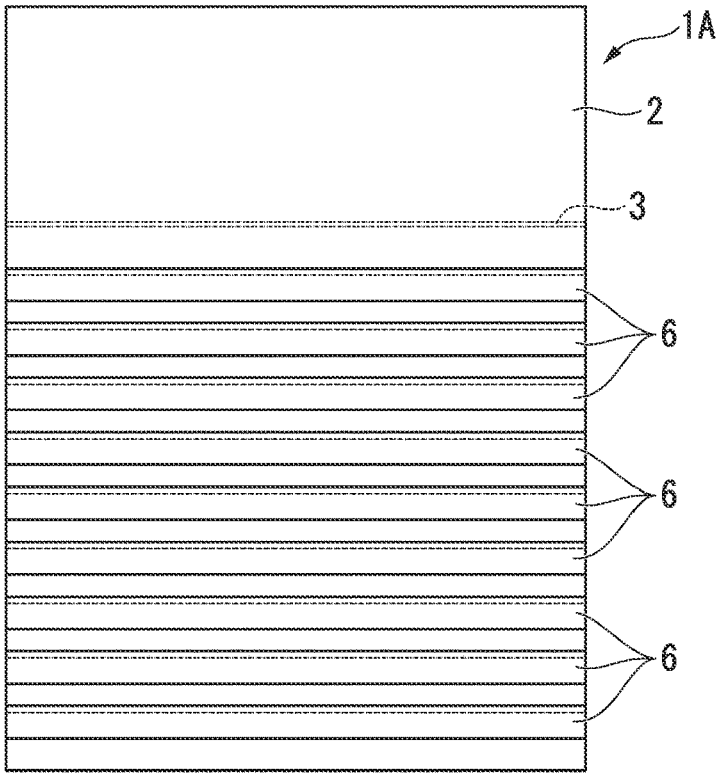
FIG. 7B is a view as seen from the direction of an arrow B in FIG. 7A showing the schematic structure of the free-standing liner unit according to the variant example of the embodiment of the present invention.

For example, in the above-described embodiment, a structure in which the anchor bolts 5 that penetrate the outer tank liner plate 2, the secondary barrier plate 3, and the cold insulator layer 4 are used as the reinforcing means of the present invention. However, the present invention is not limited to this. For example, it is also possible to use ribs as the reinforcing means of the present invention. FIGS. 7A and 7B show the schematic structure of a free-standing liner unit 1A that is provided with ribs, with FIG. 7A being a vertical cross-sectional view and FIG. 7B being a view as seen from the direction of an arrow B shown in FIG. 7A. As is shown in the drawings, in this free-standing liner unit 1A, a plurality of ribs 6 are placed on the outer tank liner plate 2. The length of the rib 6 is the same as the width of the outer tank liner plate 2, and the plurality of the ribs 6 are positioned equidistantly in the height direction. By installing the ribs 6 in this manner, the rigidity of the outer tank liner plate 2 is increased and, in conjunction with this, the rigidity of the free-standing liner units 1A is also increased. Using this type of free-standing liner unit 1A as well, the free-standing liner units 1A are able to easily withstand the liquid pressure of the concrete when the free-standing liner units 1A are used as a forming frame. Note that, in the same way as the anchor bolts 5, the ribs 6 may also be installed at a higher density in the bottom portion of the free-standing units 1A which receives a greater liquid pressure than in the top portion thereof.

INDUSTRIAL APPLICABILITY

According to the present invention, when building a tank, it is possible to shorten the construction period by performing the formation of the outer tank shell plates and the formation of the tank internal structure concurrently with each other, and to achieve an improvement in the handleability of the free-standing liner units.

DESCRIPTION OF THE REFERENCE NUMERALS

1 . . . Free-standing liner unit, 1A . . . Free-standing liner unit, 2 . . . Outer tank liner plate, 3 . . . Secondary barrier plate, 4 . . . Cold insulator layer, 5 . . . Anchor bolt, 6 . . . Rib, 10 . . . Tank, 11 . . . Base slab, 12 . . . Outer tank, 12*a* . . . Outer tank shell plate, 12*b* . . . Outer tank roof, 13 . . . Bottom plate, 13*a* . . . Bottom liner plate, 13*b* . . . Dry sand layer, 13*c* . . . Foam glass layer, 13*d* . . . Dry sand layer, 13*e* . . . Leveling concrete, 13*f* . . . Perlite concrete block, 13*g* . . . Reinforced concrete, 14 . . . Inner tank, 14*a* . . . Inner tank shell plate, 14*b* . . . Inner tank deck, 14*c* . . . Inner tank bottom plate, 14*d* . . . Annular plate, 15 . . . Resilient blanket,

16 . . . First cold insulating layer, 17 . . . Secondary barrier, 18 . . . Second cold insulating layer, 19 . . . Outer tank liner, 20 . . . Anchor strap, 31 . . . Stand, 32 . . . Supporting column, 33 . . . Supporting pedestal, 34 . . . Crane

What is claimed is:

1. A free-standing liner unit comprising:

a planar outer tank liner plate which makes up a portion of an outer tank liner when the outer tank liner plate is erected on top of a base slab;

a planar secondary barrier plate which makes up a portion of a secondary barrier, which surrounds a bottom portion of an inner tank and is configured to block leakage of liquefied natural gas when liquefied natural gas leaks out from the inner tank, when the secondary barrier plate is erected on top of the base slab; and a cold insulator layer that is interposed between the outer tank liner plate and the secondary barrier plate and makes up a portion of a cold insulating layer which surrounds an entire circumference of the secondary barrier when the cold insulator layer is erected on top of the base slab, wherein the outer tank liner plate, the secondary barrier plate, and the cold insulator layer are integrated into a single unit, A) wherein a position of a bottom edge of the secondary barrier plate, which is a lowermost position of the secondary barrier plate in a height direction, is at a same position as a bottom edge of the outer tank liner plate, which is a lowermost position of the outer tank liner plate in the height direction, and B) wherein the single unit of the free-standing liner unit is configured for being erected on top of the base slab with the bottom edges of the secondary barrier plate and the outer tank liner plate aligned in direct contact with the base slab.

2. The free-standing liner unit according to claim 1, further comprising a reinforcing means that is fixed to at least one of the outer tank liner plate, the secondary barrier plate, and the cold insulator layer, and provides improved rigidity.

3. The free-standing liner unit according to claim 2, wherein the reinforcing means takes the form of anchor bolts that penetrate the outer tank liner plate, the secondary barrier plate, and the cold insulator layer.

4. The free-standing liner unit according to claim 2, wherein the reinforcing means takes the form of ribs that are fixed to the outer tank liner plate.

5. A method of building a tank comprising:

a step of erecting free-standing liner units according to claim 1;

a step of forming outer tank shell plates that are made of concrete on the outer tank liner plate side of the free-standing liner units; and a step of forming a tank internal structure on the secondary barrier plate side of the free-standing liner units concurrently with the step of forming the outer tank shell plates.

6. The free-standing liner unit according to claim 1, wherein a top edge portion of the secondary barrier plate is bent towards the outer tank liner plate so that the top edge portion of the secondary barrier plate is connected to the outer tank liner plate.

7. The free-standing liner unit according to claim 1, wherein the outer tank liner plate, the secondary barrier plate, and the cold insulator layer are integrated into a single free-standing unit which is separable as a unit from the base slab.

* * * * *